US005797514A

United States Patent [19]

Twiggar et al.

[11] Patent Number: 5,797,514

[45] Date of Patent: Aug. 25, 1998

[54] ICE BIN LINER WITH SANITARY JOINT

[75] Inventors: Andrew J. Twiggar, Bethlehem; Dale S. Berger, Nazareth, both of Pa.

[73] Assignee: Follett Corporation, Easton, Pa.

[21] Appl. No.: 719,931

[22] Filed: Sep. 25, 1996

[51] Int. Cl.[6] ..... B65D 7/32

[52] U.S. Cl. ..... 220/683; 220/685

[58] Field of Search ..... 220/461, 467, 220/470, 408, 410, 683, 685, 62

[56] References Cited

U.S. PATENT DOCUMENTS

| | | | |
|---|---|---|---|
| 296,444 | 4/1884 | Perkins . | |
| 967,383 | 8/1910 | Hunter . | |
| 1,119,133 | 12/1914 | Wheary . | |
| 1,235,948 | 8/1917 | Wheary . | |
| 1,381,149 | 6/1921 | Wheary . | |
| 1,675,654 | 7/1928 | Mahar . | |
| 2,457,002 | 12/1948 | Spiro | 220/685 X |
| 3,044,658 | 7/1962 | Combs et al. | 220/685 X |
| 3,436,928 | 4/1969 | Swerbinsky | 62/137 |
| 3,454,187 | 7/1969 | Rees | 220/73 |
| 3,716,259 | 2/1973 | Weill et al. | 220/685 X |
| 3,989,157 | 11/1976 | Veenema | 220/683 X |
| 4,002,287 | 1/1977 | Saveth | 220/62 X |
| 4,189,885 | 2/1980 | Fritz | 52/287 |
| 4,278,196 | 7/1981 | Ford | 229/30 |
| 4,483,444 | 11/1984 | Gardner | 206/594 |
| 4,949,929 | 8/1990 | Kesselman et al. | 248/300 |
| 5,000,301 | 3/1991 | Grenier | 190/127 |
| 5,221,136 | 6/1993 | Hauck et al. | 220/467 X |
| 5,255,782 | 10/1993 | Carroll, Jr. | 220/62 X |
| 5,267,651 | 12/1993 | Hughes | 206/453 |
| 5,301,477 | 4/1994 | Rellinger et al. | 52/36.1 |
| 5,431,412 | 7/1995 | Reinhard et al. | 277/1 |

OTHER PUBLICATIONS

One-piece Ice Bin Liner Drawing, dated Jul. 7, 1988, p. 1 of 1.

One-piece Ice Bin Liner Drawing, dated May 20, 1994, p. 1 of 1.

*Primary Examiner*—Steven M. Pollard

*Attorney, Agent, or Firm*—Paul & Paul

[57] ABSTRACT

An ice bin for storing manufactured ice therein, having four walls and a floor and provided with a bin liner disposed in the ice bin adjacent the four walls of the ice bin. The liner has four, generally planar panels which are connected by at least one edge joint. Each edge joint has two slots formed at right angles to one another, each slot formed by two legs for holding two adjacent liner panels at generally right angles to one another. Each joint further has two spacers disposed adjacent each slot and generally at right angles to each slot for defining a space for insulation between the ice bin and liner panels, to aid in assembly, and to contribute to the strength of the liner.

23 Claims, 8 Drawing Sheets

ICE BIN LINER WITH SANITARY JOINT

FIELD OF THE INVENTION

The present invention relates to an ice storage bin for use with commercial ice making equipment. More particularly, the invention relates to an apparatus in which an ice bin liner is used in conjunction with an ice storage bin for commercial ice making equipment in which the ice bin liner uses one or more sanitary joints for connecting flat panels of the ice bin liner together.

BACKGROUND OF THE INVENTION

Ice has long been provided in many forms to meet various commercial demands. Among the many forms of ice are cubes, blocks, shavings, or chips which are all available within the commercial market. Ice is widely and popularly used, for example, in supermarkets, restaurants, hotels, marinas, recreational centers, and other facilities. For example, ice can be used in seafood and produce display cases where perishable items are to be openly viewed, as well as placed in glasses for chilling beverages.

Generally, sizable quantities of particulate ice are stored within a holding bin to facilitate the availability of ice, so that the amount of ice needed in a given instance may be removed from the holding bin and placed in transport containers. Once the ice has been made, whether as ice shavings, cubes, cylinders, etc., such particles usually reside within the holding bin until dispensed. For example, an ice storage bin of one type is disclosed in U.S. Pat. No. 5,211,030, which is hereby incorporated by reference.

To prevent such melting by providing means for improved insulation, as well as providing improved sanitary capabilities, and corrosion resistance, plastic bin liners have been used. These plastic bin liners have typically been made using a rotomolded process which is relatively expensive and lacks versatility in that a separate mold typically must be made for every different size bin for which a bin liner is desired.

The present invention for a bin liner yields a considerably less expensive and more versatile liner, as to ease of changing configuration. Standard extruded sheets of plastic are used in the bin liner of the present invention, and the bin liner corners and side wall connections are constructed using the unique joints of the present invention, thereby enabling an infinite array of sizes of bins to be constructed with no other special materials.

It is highly desirable to line ice storage bins in this inexpensive manner that is sanitary, has good insulation characteristics, is corrosion resistant, and is flexible in design. The present invention yields all of these features.

SUMMARY OF THE INVENTION

The present invention is directed to an apparatus for storing ice. More particularly, in one preferred embodiment, the apparatus is directed toward an ice storage bin for storing manufactured ice therein. The ice storage bin has four walls and a floor and is provided with a sanitary liner disposed inside the bin adjacent to the four ice bin walls. The liner has four panels connected by at least one edge joint. The edge joint has two slots formed at right angles to one another, each slot formed by two legs, for holding two liner panels at generally right angles to one another. The edge joint also has two spacers adjacent to each slot and generally at right angles to each slot for defining a space for insulation between the ice bin and liner panels, to contribute to strength of the liner, and to provide means to facilitate assembly of the ice bin liner. The edge joint also helps to lock the insulation in place. Optionally, special corner joints may be used when a liner floor is desired. Also, special panel-extension joints may be used for very large bins such that a single panel may be made with two or more standard extruded sheets to form a single liner panel. The liner panels may be formed optionally with one, two, three, or four-piece, panel sections, folded as required.

It is accordingly an object of the present invention to provide a novel ice storage ice bin with a sanitary and corrosion resistant ice bin liner that can be manufactured at low cost.

A further object of the present invention is to provide an ice storage bin with a sanitary and corrosion resistant ice bin liner, where the ice bin liner comprises four side panels, and an optional bottom panel, where at least two panels are connected by a sanitary joint.

A further object of the present invention is to provide an ice storage bin with a sanitary and corrosion resistant ice bin liner for a low cost where leaks are minimized and where sanitary conditions can be easily maintained.

A further object of the present invention is to provide an ice storage bin with a sanitary and corrosion resistant ice bin liner, where the ice bin liner can easily be manufactured in many different sizes at low cost.

A further object of the present invention is to provide an ice storage bin having a sanitary and corrosion resistant ice bin liner, having four panels, where at least two panels are connected by a sanitary joint having spacers protruding outwardly from the sanitary joint providing assembly strength and a means to facilitate assembly of the panels to the joint.

A further object of the present invention is to provide an ice storage bin having a sanitary and corrosion resistant ice bin liner, having four panels, wherein at least two of the panels each comprise two or more separate standard extruded sheets connected by a panel-extension joint to yield one larger panel.

Other objects and advantages of the present invention will become apparent from the following description taken in conjunction with the accompanying drawings.

BRIEF DESCRIPTION OF THE DRAWINGS

FIG. 13*b* is a perspective view of a bin liner of the present invention, having the panel-extension joint of FIG. 13a.

DESCRIPTION OF THE PREFERRED EMBODIMENT

Figure 1:
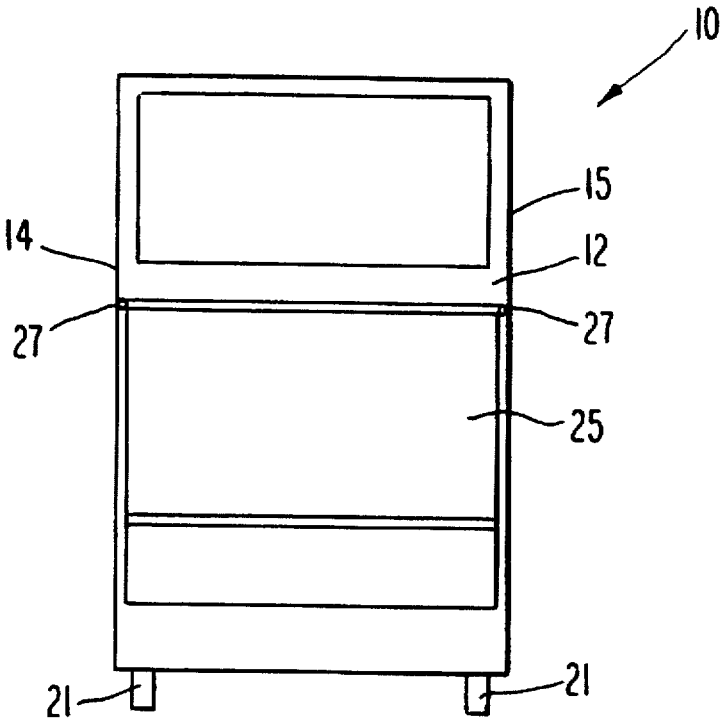
FIG. 1 is a front elevational view of a typical ice storage bin in which the bin liner of the present invention is used.
Figure 2:
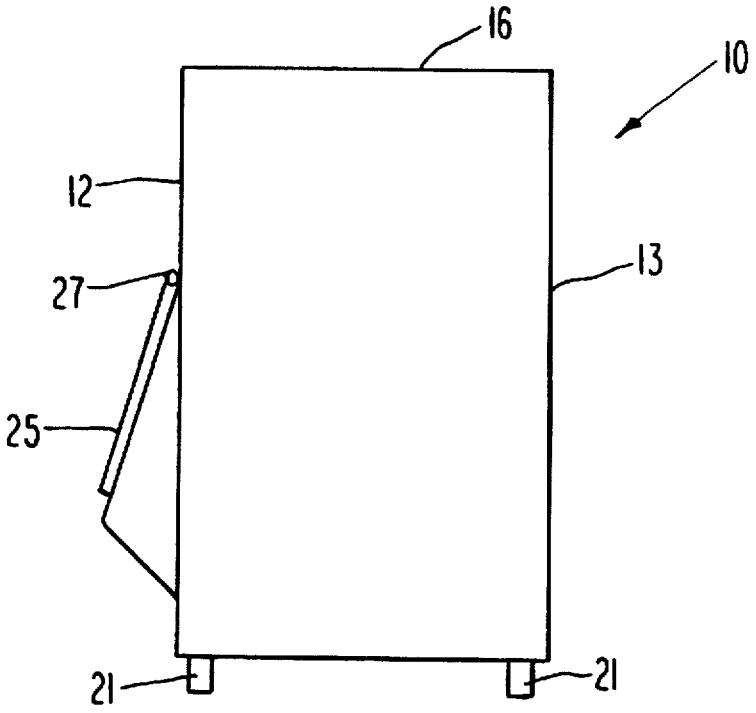
FIG. 2 is a side elevational view of the ice storing apparatus of FIG. 1.
Figure 3:
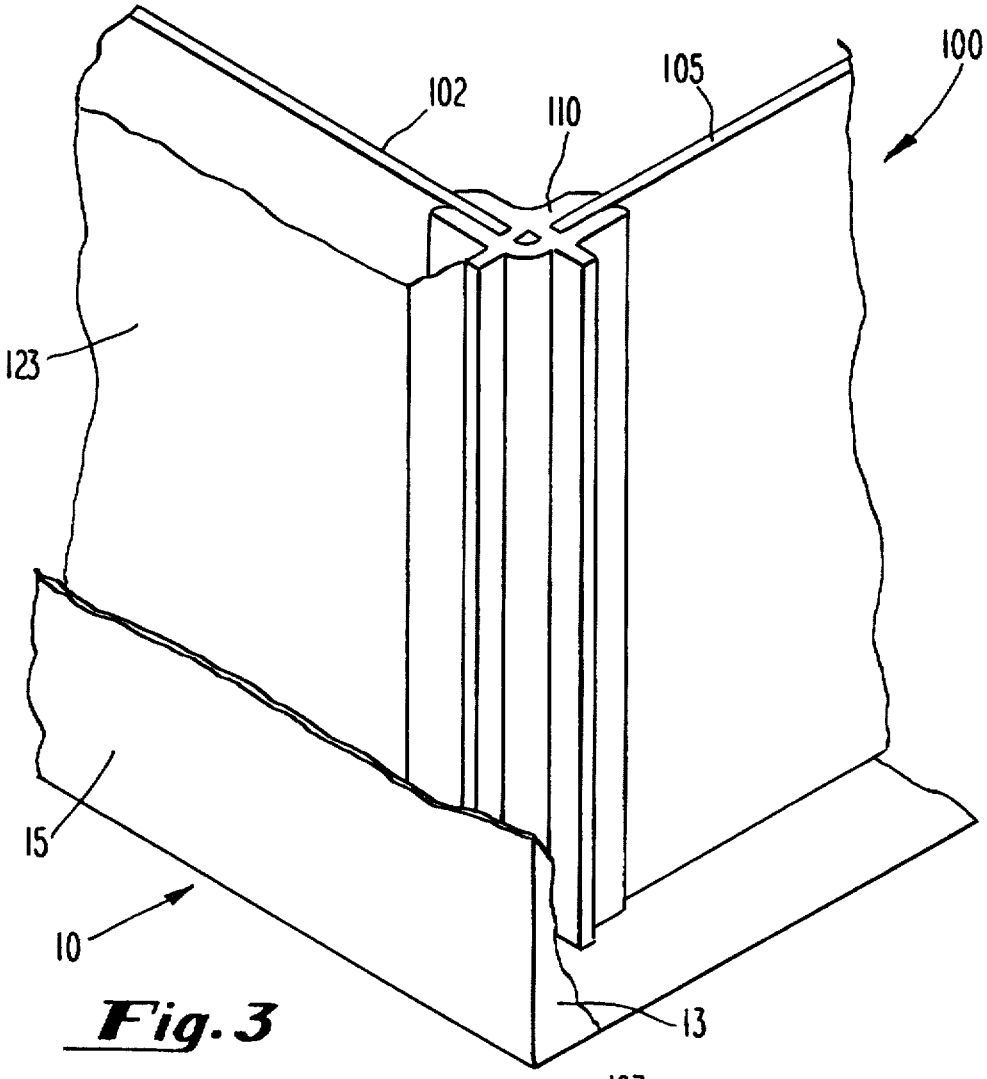
FIG. 3 is a partial, cutaway, perspective view of the ice bin, including the ice bin liner with edge joint of the present invention.

Referring now in detail to the drawings, wherein like reference numerals indicate like elements throughout the several views, there is shown in FIGS. 1, 2, and 3 an ice bin 10 of the present invention. As shown in FIG. 3, which depicts a partial, cutaway, perspective view of the ice bin 10 of FIGS. 1 and 2, there is provided the ice bin 10, including the ice bin liner 100 of the present invention. The ice bin 10 is provided having a front wall 12, a rear wall 13, a pair of side walls 14 and 15, and a top wall 16. A plurality of vertical leg members 21 are shown extending from and supporting the bin 10 off the floor.

The bin 10 may accommodate, for example, a pair of ice makers (not shown) for delivering ice into the ice bin 10. The bin 10 is preferably insulated, as described in detail below, and may further be provided with a suitable means for regulating and maintaining a bin temperature of about a minimum of 32° F., or preferably lower (not shown).

Access means are provided for facilitating the removal of ice from the bin, for example, comprising door 25 shown in FIGS. 1 and 2. The door 25 pivots on hinge pair 27.

Figure 4:
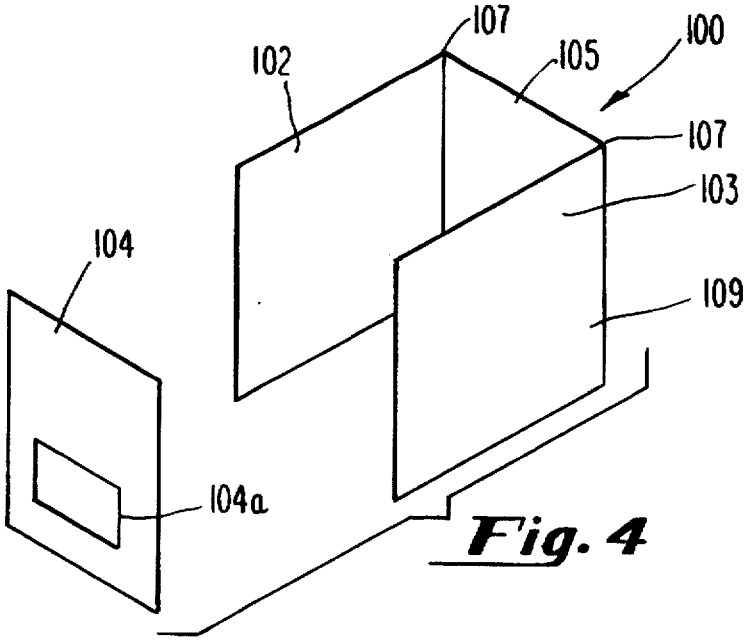
FIG. 4 is a simplified, perspective view of a first embodiment of the side panels having a two-part panel for the ice bin liner of the present invention, prior to assembly with the edge joint as depicted in FIG. 3.

The ice bin liner 100 of the present invention comprises bin liner edge joints 110 (FIGS. 3 and 8), constructed preferably as an extrusion of, for example, A.B.S. plastic. As depicted in FIG. 4, panels 102 and 103, 104, and 105, preferably manufactured from extruded sheet plastic, such as extruded polyethylene, form the four sides of the liner 100, panels 102 and 103 being the sides, panel 105 being the back, and panel 104 being the front panel with an access port 104*a* for receiving ice through door 25. The four panels 102, 103, 104, 105 of the liner 100 may be formed either in two, three, or four pieces, as described below.

In a first embodiment of the bin liner 100, as can be seen in FIG. 4, a three-sided panel 109 is used where extruded sheet plastic is folded, by means known in the art, in two places 107 to form two sides 102, 103 and back 105 of the liner 100. A second, flat panel is provided that forms the fourth, front panel 104 of the liner 100. In this embodiment, two unique edge joints 110 of the present invention are provided for assembling the front panel 104 to the two side panels 102, 103 of the liner.

Figure 5:
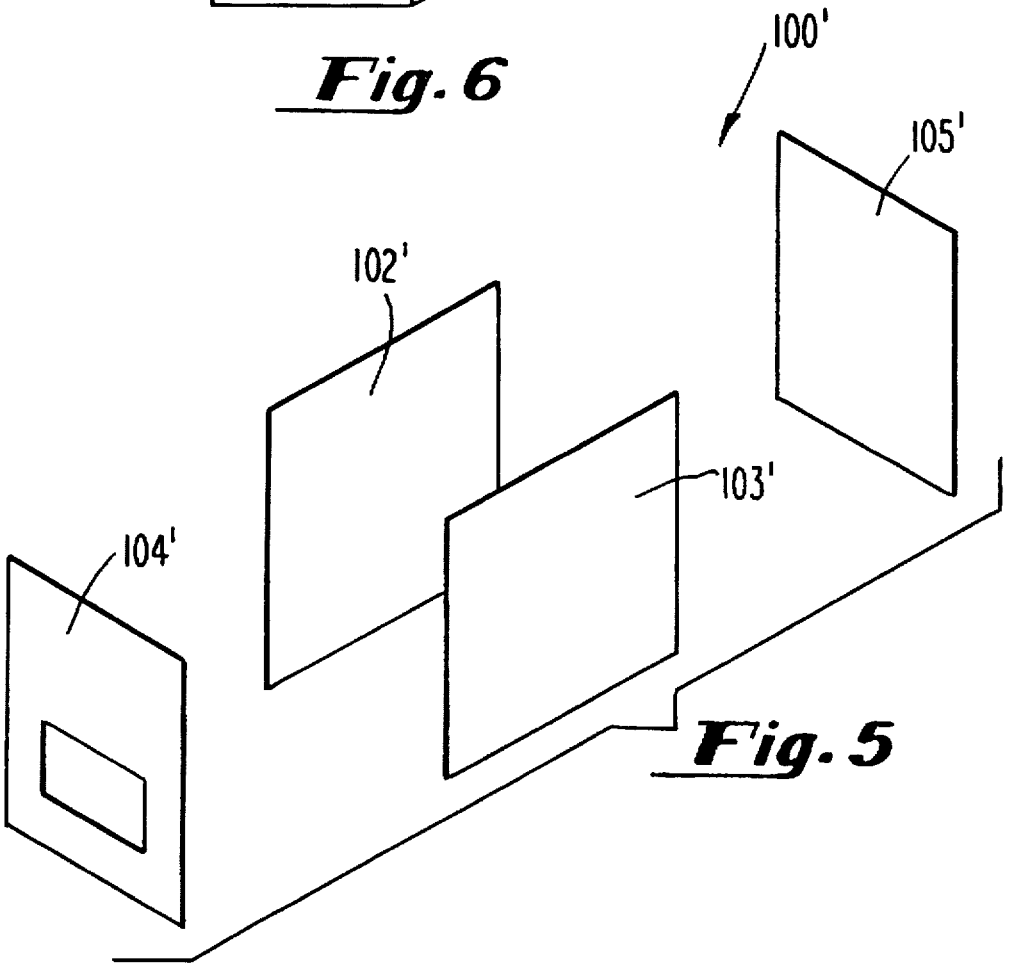
FIG. 5 is a simplifed, perspective view of a third embodiment of the side panels having a four-part panel for the ice bin liner of the present invention, prior to assembly with the edge joint as depicted in FIG. 3.

In a second embodiment of the bin liner 100', four separate panels 102', 103', 104', 105', form the four sides of the bin, as can be seen in FIG. 5. In this embodiment, all four bin edges contain edge joints (not shown).

Figure 6:
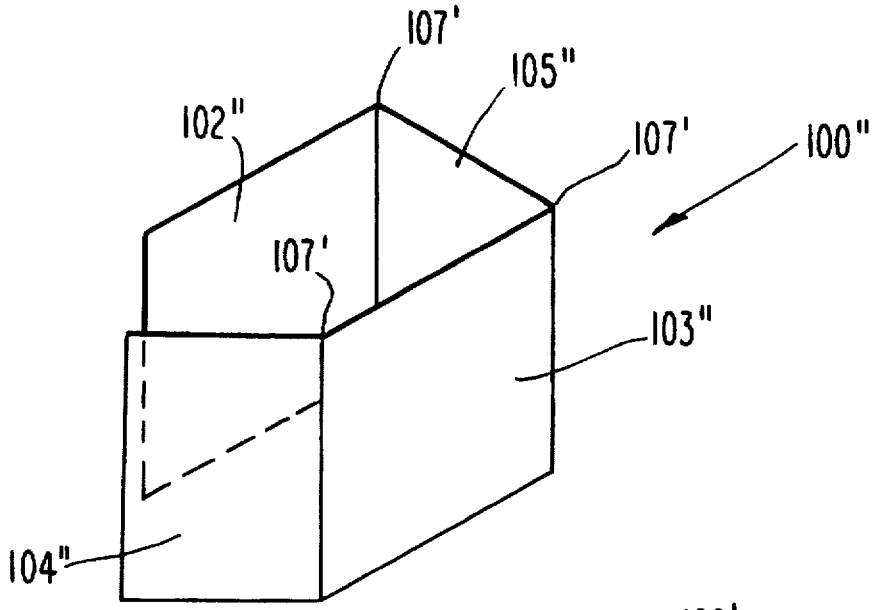
FIG. 6 is a simplified, perspective view of a second embodiment of the side panels having a one-part panel for the ice bin liner of the present invention, prior to assembly with the edge joint as depicted in FIG. 3.

In a third embodiment of the bin liner 100", one liner wall panel is folded in three places 107' such that only one edge joint is required, as can be seen in FIG. 6.

Other combinations of folded panels and edge joints may also be used and are within the scope of the present invention.

Figure 7:
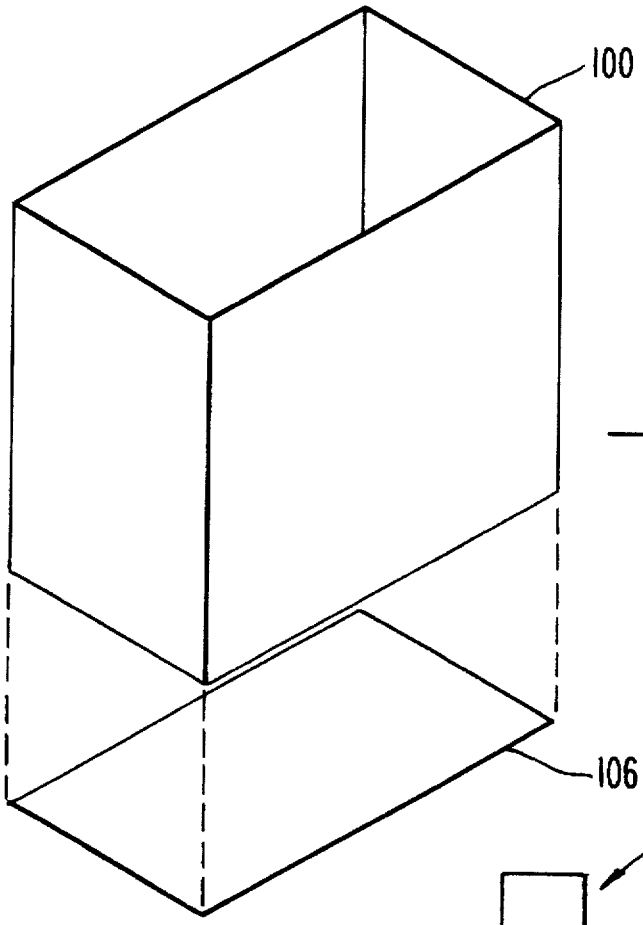
FIG. 7 is a simplified, perspective view of fourth embodiment of the side panels for the ice bin liner of the present invention, prior to assembly with the edge joint as depicted in FIG. 3, depicting an optional bottom panel.
Figure 9:
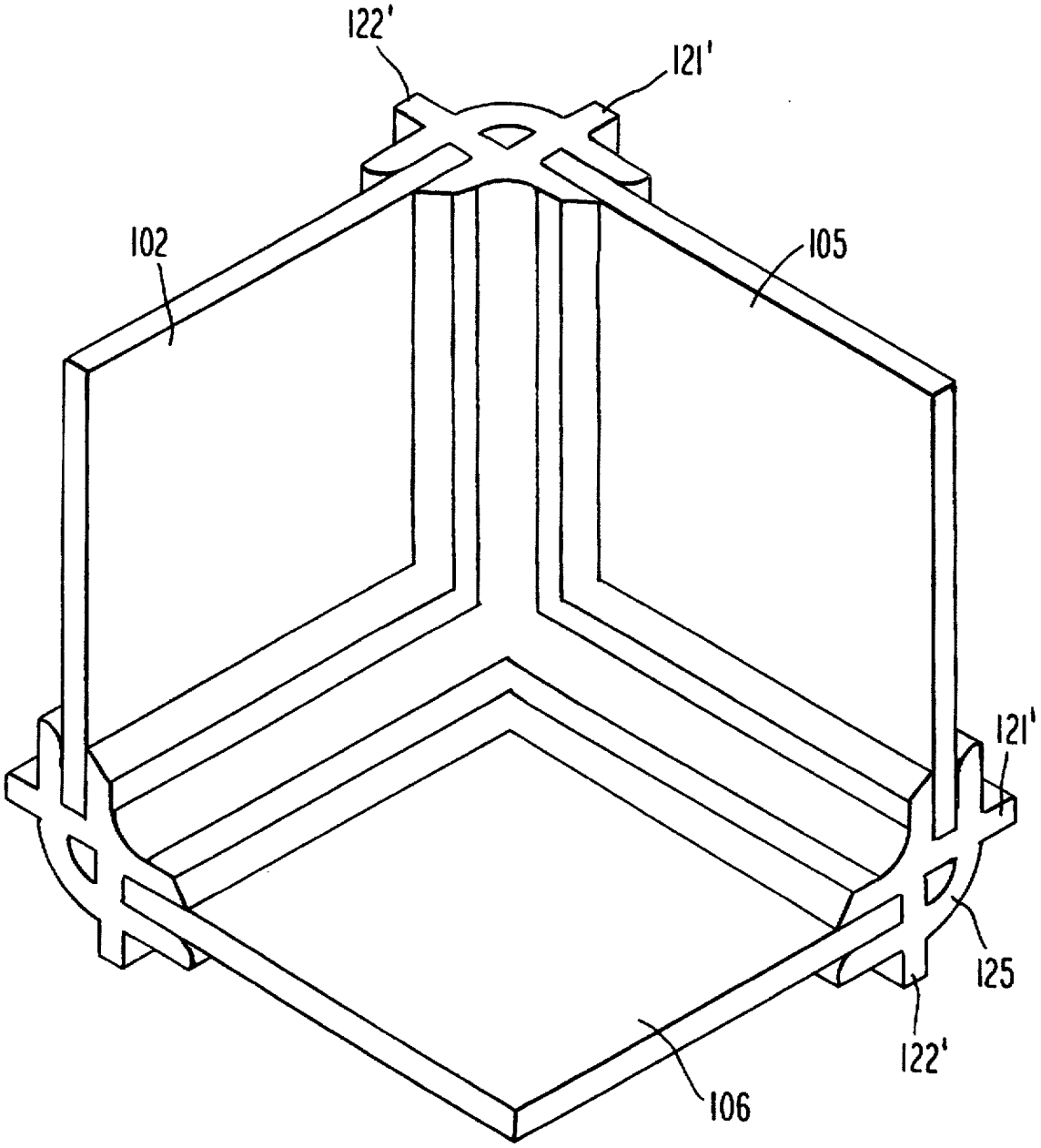
FIG. 9 is a perspective view of an optional corner joint of the ice bin liner of the present invention, as used when the optional bottom panel as depicted in FIG. 7 is desired.

Finally, as can be seen in FIG. 7, the above three embodiments of the bin liner 100, 100' and 100" may have an optional floor panel 106. If the floor panel 106 is used, a special variation of the edge joint may be used in the form of one-piece corner joint 125 to provide a tight seal, as depicted in FIG. 9. Here, three panels (two walls and a floor 106) may be attached at right angles to one another. The corner joint 125 optionally may have spacers 121', 122' for use similar to that of the edge joints 110, as described below.

Figure 8:
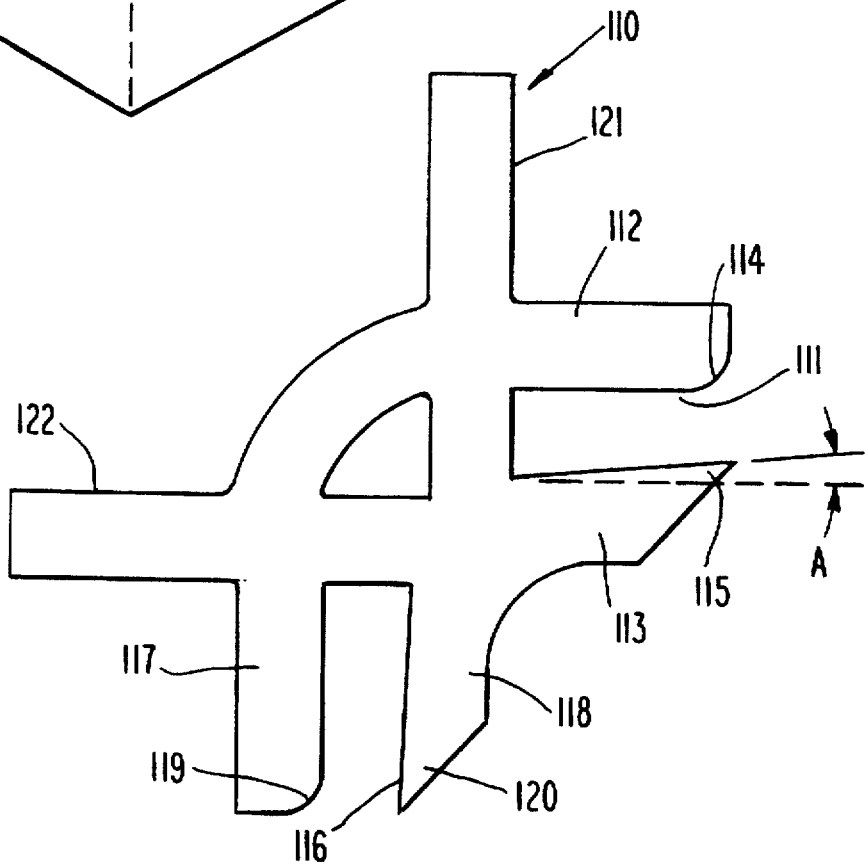
FIG. 8 is a cross-sectional view of the a first embodiment of the edge joint of the ice bin liner of the present invention.

As can be seen in FIGS. 3 and 8, in a first embodiment of the edge joint 110, the edge joint 110 comprises two slots 111, 116 and two protruding spacers 121, 122. The two slots 111, 116, each formed by a pair of legs, 112, 113 and 117, 118 respectively, are disposed at right angles to one another, each slot 111, 116 adapted to receive a panel (for example 102, 103, 104 or 105, as shown in FIG. 4). Extending perpendicular to each of the two slots 111, 116, are the two protruding spacers 121, 122, also at right angle to one another and integral to the edge joint 110. These spacers 121, 122 allow room for sufficient insulation between the plastic walls of the bin liner and the ice bin 10 itself. When a bin liner 100 is assembled (see FIG. 3), spacers 121, 122 may or may not extend to the outer walls 12, 13, 14, 15 of the ice bin 10, to save excess material, in that it is typically desired that insulation 123 fills in a substantial portion of the space between bin liner 100 and the ice bin 10. Optionally, the spacers can extend to the outer walls 12, 13, 14, 15 (see FIGS. 1 and 2) of the ice bin 10 to provide increased assembly strength. The protruding spacers 121, 122 in the edge joint 110 provide a space for insulation, for example, a flow path for typical foamed-in-place insulation used in the industry, strengthening bars to contribute to the strength of the foamed wall section, and handling points to aid in assembly.

In the configurations of FIGS. 4 and 6, only two or one edge joints 110 are required, respectively. Preferably, the edge joints 110 here are located at the front of the bin 10, adjacent access port 104*a*. Here, potential damage to the edge joints 110 from shovels and picks and leak potential is reduced, since, if the joints are located in the front of the bin, potential damage from direct strikes from shovels and picks is minimized.

Referring now in particular to the embodiment of FIG. 8, a further important feature of the edge joint 110 is the configuration of the legs 112, 113 and 117, 118, forming slots 111 and 116 respectively. The slots 111, 116 are open-ended and generally rectangular in cross-section. It is desirable that the liner panels 102, 103, 104, 105 be manufactured for clearance at the closed end of the slot, however, it is also desirable that the legs of the slot 112, 113 and 117, 118 converge slightly such that there is a slight interference fit at the open end of the slot to firmly hold the liner walls and to provide a more sanitary joint. Thus, it is desirable to have a slight interference fit at the open front end of each slot 111, 116, such that the elastic nature of the plastic used in the joint forms a tight grip on the adjacent panel. As can be seen in FIG. 8, the inside legs 113 and 118 angle inward toward its adjacent leg 112, 117 such that angle A is achieved. The actual dimension of angle A is not critical. To allow for easy insertion the outside legs 112, 117 each have a radius on its inner surface 114, 119, such that when a panel is inserted, it readily slides into place, but is still held securely by the interference fit. Finally, the inner legs 113, 118 of the edge joint 110 preferably come to generally sharp points 115, 120 to enhance cleanliness and to provide a smooth transition from panel to edge joint 110 to panel.

Figure 10:
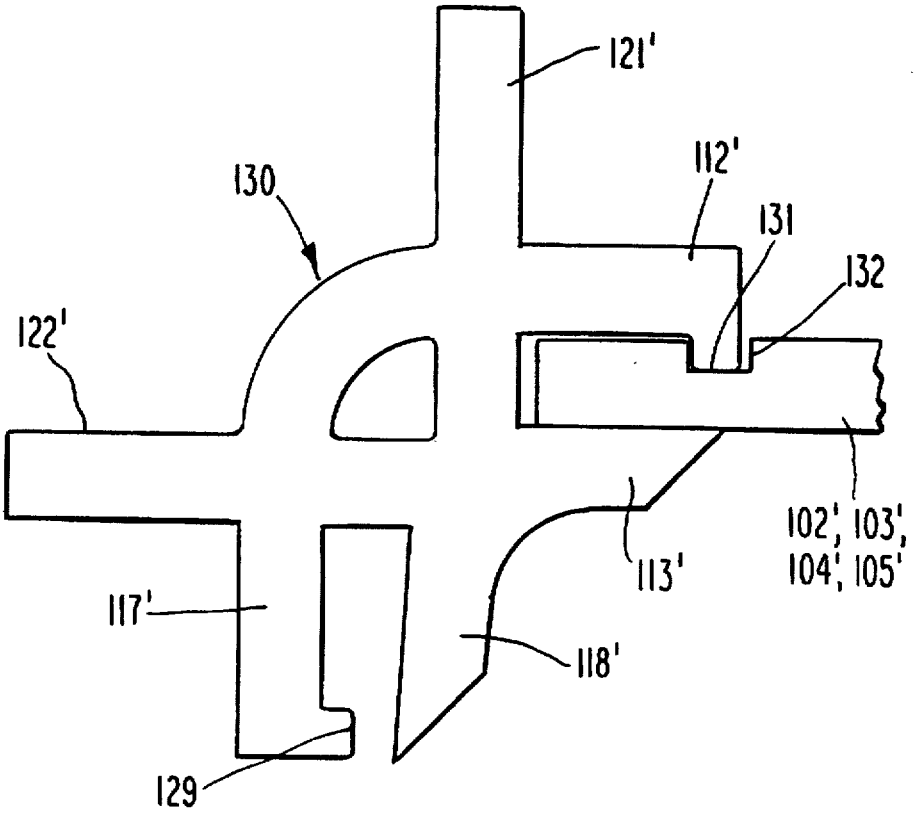
FIG. 10 is an alternate cross-sectional view of the embodiment of the edge joint of FIG. 8, having a tongue-and-groove feature to enhance joint integrity.
Figure 11:
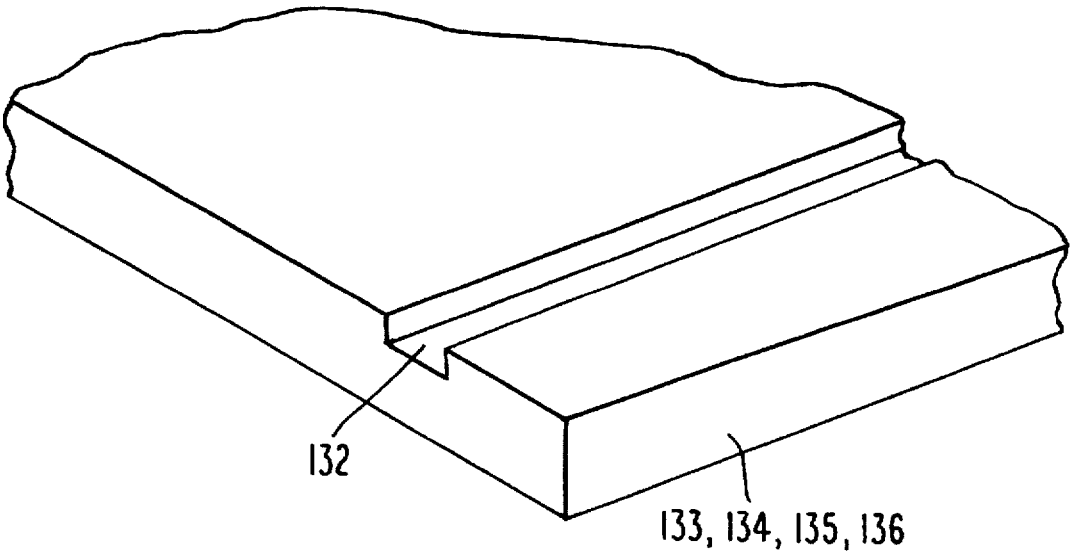
FIG. 11 is a partial perspective view of panel preparation required for the alternate tongue-and-groove edge joint of FIG. 10.

As depicted in FIGS. 10 and 11, in an alternate embodiment of the edge joint 130, the attachment means between the flat panel and the joint itself may include a tongue-and-groove feature to enhance structural integrity of the bin liner. FIG. 10 depicts a cross-sectional view of the edge joint 130 where tabs 129, 131 are disposed on legs 112', 117' respectively. FIG. 11 depicts a partial side view of a panel having the "groove" or slot 132 of the tongue-and-groove feature. The slot 132 runs the length of each panel (102', 103', 104' or 105') adjacent to the edge joint 130. This embodiment has the added advantage of greater structural integrity, however, it is more expensive to manufacture due to the added step of creating the groove in each panel adjacent to the edge joint 130. In an alternate embodiment, the slot could be manufactured into the edge joint, while the tab could be disposed on the panel (not shown).

Figure 12:
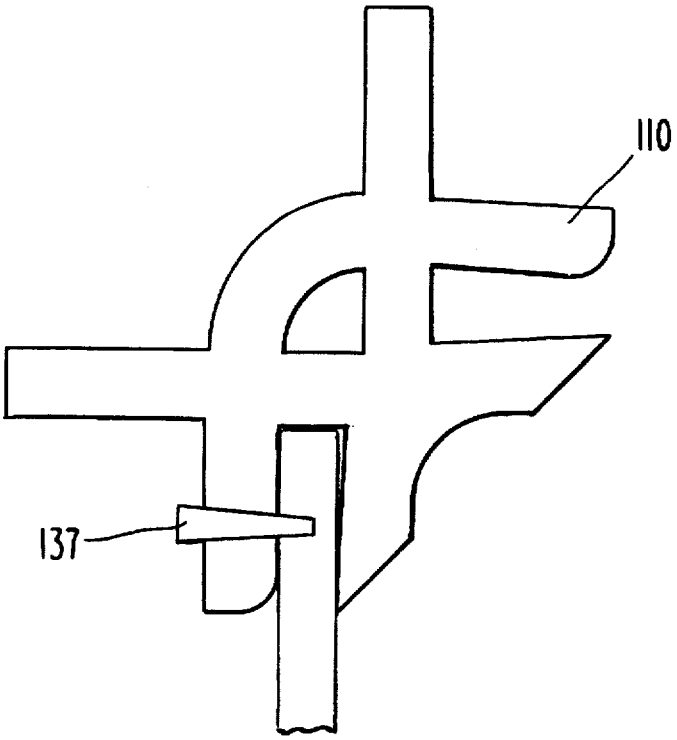
FIG. 12 is a cross-sectional view of the edge joint as depicted in FIG. 3, depicting an optional pinned joint to enhance structural integrity.

Optionally, as can be seen in FIG. 12, to increase the structural integrity of the bin liner 100, one or more pins 137 may be installed down the length of each joint 110 or 130, preferably from the outside of the liner into panel 102, 103, 104, 105, and also through corner joint 125, if desired. Again, this added feature increases the structural integrity of the bin liner 100 without adding significantly to manufacturing cost or flexibility of use.

Figure 13A:
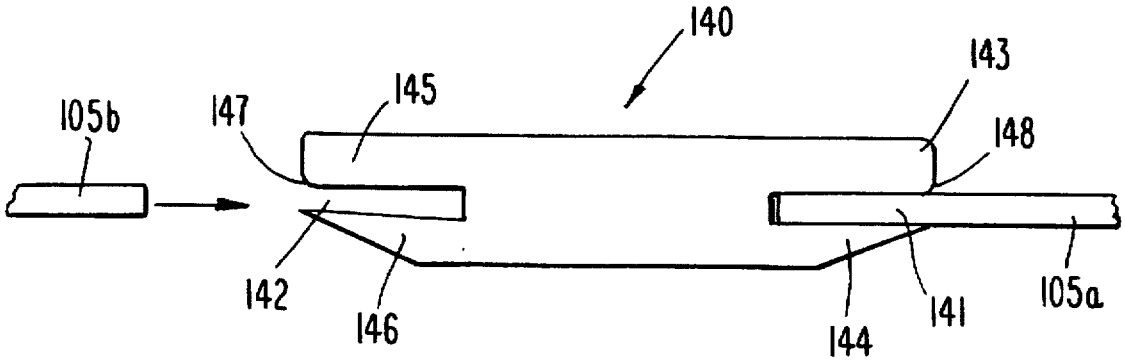
FIG. 13*a* is a cross-sectional view of a panel-extension member with adjacent panels, as may be used in constructing the present bin liner to make large bin liner panels from standard extruded sheets.
Figure 13B:
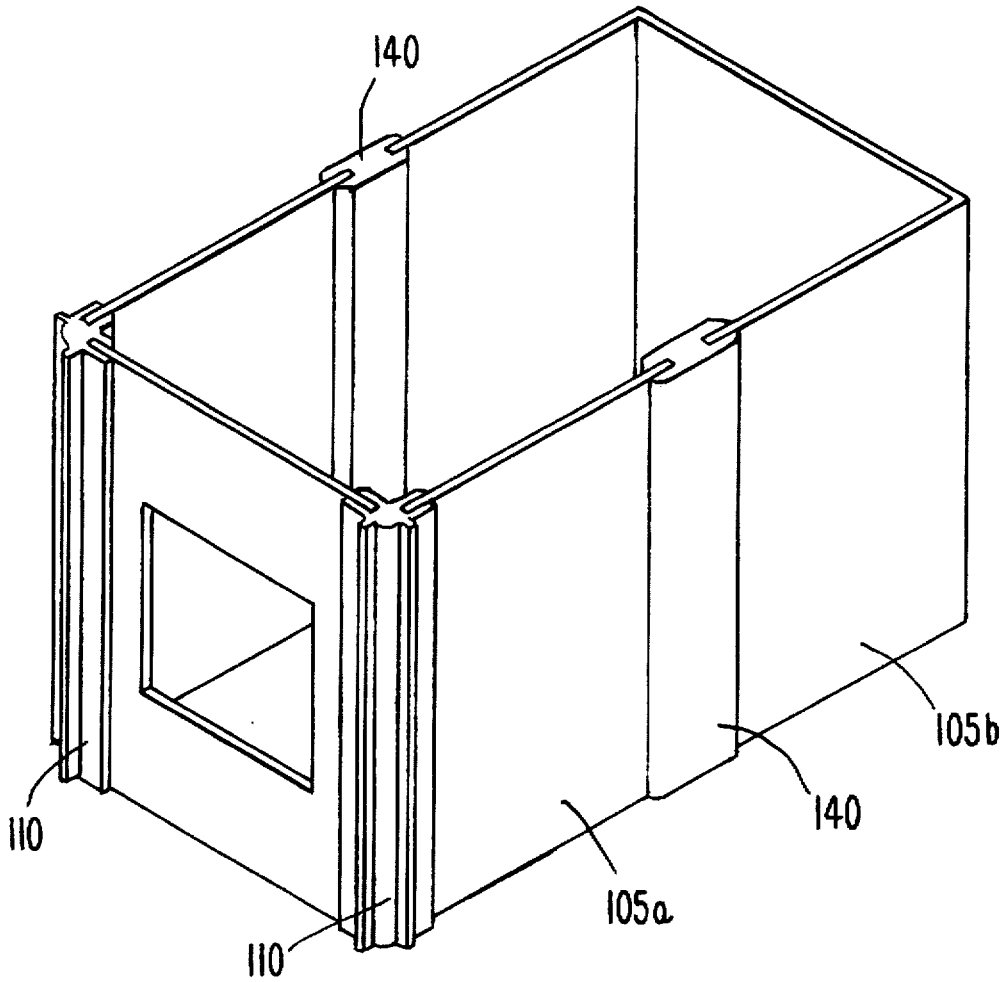

Finally, as can be seen in FIGS. 13*a* and 13*b*, particularly to accommodate large bin sizes, a panel-extension joint 140 may be used to create large panels of two or more smaller sheets of plastic to form a single, larger liner panel, for example, 105*a*, 105*b*. By combining two or more smaller sheets to yield one large panel, standard extruded P.V.C. sheet may be used to create large bins where a single standard sheet of A.B.S., or similar material, is not large enough. The panel-extension joint 140, like the edge joint, is constructed as an extrusion of, for example, A.B.S. plastic.

As can be seen in FIGS. 13*a* and 13*b*, the panel-extension joint 140, comprises two slots 141, 142. The two slots 141, 142, each formed by a pair of legs, 143, 144 and 145, 146, respectively, are disposed adjacent one another such that two side-by-side panels, for example 105*a* and 105*b* may be mounted to form one larger panel. Each slot 141, 142 is adapted to receive a panel in a similar manner to that of the edge joint 110, as described above.

As in the edge joint 110, as seen in FIG. 8, a further important feature of the panel-extension joint 140 is the configuration of the legs 143, 144 and 145, 146 forming slots 141 and 142 respectively. The slots 141, 142 are open-ended and generally rectangular in cross-section. As with the edge joint 110, it is desirable that the liner panels 102, 103, 104, 105 be manufactured for clearance at the closed end of the slot, however, it is also desirable that the legs of the slot 143, 144 and 145, 146 converge slightly such that there is a slight interference fit at the open end of the slot to firmly hold the liner walls and to provide a more sanitary joint. Thus, it is desirable to have a slight interference fit at the open front end of each slot 141, 142, such that the elastic nature of the plastic used in the joint forms a tight grip on the adjacent panel. To allow for easy insertion, the outside legs 143, 145 each have a radius on its inner surface 147, 148, such that when a panel is inserted, it readily slides into place, but is still held securely by the interference fit. Finally, again as is similar to that of the edge joint 110, the inner legs 144, 146 of the panel-extension joint 140 preferably come to generally sharp points to enhance cleanliness and to provide a smooth transition from panel to edge joint 110 to panel. Additionally or alternatively, like edge joint 110, the "tongue-and-groove" and/or pinned features may also be utilized here.

It will be recognized by those skilled in the art that changes may be made in the above described embodiments of the invention without departing from the broad inventive concepts thereof. It is understood, therefore, that this invention is not limited to the particular embodiments disclosed, but is intended to cover all modifications which are within the scope and spirit of the invention as defined by the appended claims.

We claim:

1. An ice bin for storing manufactured ice therein, comprising four walls and a floor and provided with a sanitary bin liner disposed in said ice bin adjacent said four walls of said ice bin, said sanitary liner comprising a plurality of generally planar panels forming inner walls of the sanitary bin liner, and connected by at least one sanitary edge joint, said sanitary edge joint comprising means for holding two adjacent liner panels at generally right angles to one another comprising two slots formed at right angles to one another, each slot formed by an inside leg and an outside leg, each leg having an inner and an outer surface, said outer surface of said inside leg tapering to said inner surface of said inside leg to form generally sharp edges on each inside leg to provide a smooth transition between the two adjacent liner panels which form the inner walls of the sanitary bin liner, said sanitary edge joint having a smooth contoured inner surface adjacent the inner walls of the bin liner to facilitate cleanliness and wherein the slots of the edge joint have at least one leg that converges toward the other whereby slight interferences with said panels are maintained to facilitate cleanliness and structural integrity.

2. The ice bin having a sanitary liner of claim 1, wherein the edge joint comprises spacers disposed adjacent each slot and generally at right angles to each slot for defining a space for insulation between said ice bin and liner panels, to aid in assembly, and to contribute to the strength of the liner.

3. The ice bin having a sanitary liner of claim 1, wherein at least one panel comprises a plurality of separate panel sections connected by at least one panel-extension joint, said panel extension joint comprising two open-ended slots facing opposed to one another, each slot having means to accommodate a panel, such that said separate panel sections are connected by said panel-extension joint to form one contiguous panel.

4. An ice bin for storing manufactured ice therein, comprising four walls and a floor and provided with a sanitary bin liner disposed in said ice bin adjacent said four walls of said ice bin, said sanitary liner comprising a plurality of generally planar panels forming inner walls of the sanitary bin liner and connected by at least one sanitary edge joint, said sanitary edge joint comprising:

a. means for holding two adjacent liner panels at generally right angles to one another comprising two slots formed at right angles to one another, each slot formed by an inside leg and an outside leg, each leg having an inner and an outer surface;

b. two spacers disposed adjacent each slot and generally at right angles to each slot for defining a space for insulation between said ice bin and liner panels, to aid in assembly, and to contribute to the strength of the liner; and c. wherein the sanitary edge joint has generally sharp edges on each inside leg, formed by said outer surface of said inside leg tapering to said inner surface of said inside leg, to provide a smooth transition between the two adjacent liner panels which form the inner walls of the sanitary bin liner, said sanitary edge joint having a smooth contoured inner surface adjacent the inner walls of the sanitary bin liner to facilitate cleanliness.

5. The ice bin having a sanitary liner of claim 4, wherein the slots of the sanitary edge joint have at least one leg that converges toward the other whereby slight interferences with said panels are maintained to facilitate cleanliness and structural integrity.

6. The ice bin having a sanitary liner of claim 4, wherein the slots have a tongue member disposed on one leg of said slot, matable to a groove disposed in each said panel of said liner, adjacent to said edge joint.

7. The ice bin having a sanitary liner of claim 4, wherein the sanitary liner has three folded panels, perpendicular to one another to form three sides of a rectangle, constructed of a single sheet of plastic and a fourth panel connected to the three-panel section by two said edge joints.

8. The ice bin having a sanitary liner of claim 4, wherein the sanitary liner has four folded panels, perpendicular to one another to form four sides of a rectangle, constructed of a single sheet of plastic connected by a single edge joint.

9. The ice bin having a sanitary liner of claim 4, wherein the sanitary liner has four separate panels, perpendicular to one another to form four sides of a rectangle, each panel constructed of a single sheet of plastic, said four panels connected by four edge joints.

10. The ice bin having a sanitary liner of claim 4, wherein the sanitary liner has four panels, perpendicular to one another to form four sides of a rectangle, and a fifth panel forming the bottom of the bin liner.

11. The ice bin having a sanitary liner of claim 4, wherein the sanitary liner further comprises at least one corner joint to seal the bottom panel to the side panels, said corner joints comprising a plurality of slots generally at right angles to one another for holding three liner panels at generally right angles to one another to form a corner.

12. The ice bin having a sanitary liner of claim 4, wherein at least one panel comprises a plurality of separate panel sections connected by at least one panel-extension joint, said panel extension joint comprising two open-ended slots facing opposed to one another, each slot having means to accommodate a panel, such that said separate panel sections are connected by said panel-extension joint to form one contiguous panel.

13. The ice bin having a sanitary liner of claim 4, wherein the means for holding two adjacent liner panels at generally right angles to one another comprising two slots formed at right angles to one another, each slot formed by two legs, further includes a plurality of pins inserted through at least one of said legs, through said liner panel.

14. An ice bin for storing manufactured ice therein, comprising four walls and a floor and provided with a sanitary bin liner disposed in said ice bin adjacent said four walls of said ice bin, said sanitary liner comprising four, generally planar panels forming inner walls of the sanitary bin liner and connected by at least one sanitary edge joint, said sanitary edge joint comprising:

a. means for holding two adjacent liner panels at generally right angles to one another comprising two slots formed at right angles to one another, each slot formed by an inside leg and an outside leg, each leg having an inner and an outer surface, at least one leg converging toward the other leg whereby slight interferences with said panel are maintained to facilitate cleanliness and structural integrity; and b. two spacers disposed adjacent each slot and generally at right angles to each slot for defining a space for insulation between said ice bin and liner panels, to aid in assembly, and to contribute to the strength of the liner; and c. wherein the sanitary edge joint has generally sharp edges on each inside leg, formed by said outer surface of said inside leg tapering to said inner surface of said inside leg, to provide a smooth transition between the two adjacent liner panels which form the inner walls of the sanitary bin liner, said sanitary edge joint having a smooth contoured inner surface adjacent the inner walls of the sanitary bin liner to facilitate cleanliness.

15. The ice bin having a sanitary liner of claim 14, wherein the sanitary liner has three panels, perpendicular to one another to form three sides of a rectangle, constructed of a single sheet of plastic and a fourth panel connected to the three-panel section by two said edge joints.

16. The ice bin having a sanitary liner of claim 14, wherein the sanitary liner has four panels, perpendicular to one another to form four sides of a rectangle, constructed of a single sheet of plastic connected by a single edge joint.

17. The ice bin having a sanitary liner of claim 14, wherein the sanitary liner has four separate panels, perpendicular to one another to form four sides of a rectangle, each panel constructed of a single sheet of plastic, said four panels connected by four edge joints.

18. The ice bin having a sanitary liner of claim 14, wherein the sanitary liner has four panels, perpendicular to one another to form four sides of a rectangle, and a fifth panel forming the bottom of the bin liner.

19. The ice bin having a sanitary liner of claim 14, wherein the sanitary liner further comprises at least one corner joint to seal the bottom panel to the side panels, said corner joints comprising a plurality of slots generally at right angles to one another for holding three liner panels at generally right angles to one another to form a corner.

20. The ice bin having a sanitary liner of claim 14, wherein at least one panel comprises a plurality of separate panel sections connected by at least one panel-extension joint, said panel extension joint comprising two open-ended slots facing opposed to one another, each slots having means to accommodate a panel, such that said separate panel sections are connected by said panel-extension joint to form one contiguous panel.

21. The ice bin having a sanitary liner of claim 14, wherein the outside leg has a radiused surface to aid in installing of a panel.

22. The ice bin having a sanitary liner of claim 4, wherein the outside leg has a radiused surface to aid in installing of a panel.

23. The ice bin having a sanitary liner of claim 1, wherein the outside leg has a radiused surface to aid in installing of a panel.

* * * * *